United States Patent [19]

Meyer et al.

[11] Patent Number: 4,691,638

[45] Date of Patent: Sep. 8, 1987

[54] CASED TELESCOPED AMMUNITION

[75] Inventors: David A. Meyer, Plymouth; Brian B. Tasson, Anoka; Robert F. Vollmer, Bloomington; J. Bruce Warren, Wayzata, all of Minn.

[73] Assignee: Honeywell Inc., Minneapolis, Minn.

[21] Appl. No.: 729,026

[22] Filed: Apr. 30, 1985

[51] Int. Cl.[4] ..... F42B 5/02

[52] U.S. Cl. ..... 102/434; 102/430; 102/464; 220/306

[58] Field of Search ..... 220/67, 306; 102/430, 102/431, 433, 432, 434, 464–467

[56] References Cited

U.S. PATENT DOCUMENTS

| | | | |
|---|---|---|---|
| 2,866,412 | 12/1958 | Meyer et al. | 102/434 |
| 3,355,061 | 11/1967 | Ritter | 220/306 |
| 4,245,754 | 1/1981 | Ellis | 220/306 |
| 4,335,657 | 6/1982 | Bains | 102/433 |

FOREIGN PATENT DOCUMENTS

| | | | |
|---|---|---|---|
| 2044416 | 10/1980 | United Kingdom | 102/466 |

*Primary Examiner*—Harold J. Tudor
*Attorney, Agent, or Firm*—Roger W. Jensen

[57] ABSTRACT

In cased telescoped ammunition the improvement which comprises an arrangement for securing the cartridge casing to the end caps so as to enable and limit axial movement therebetween.

4 Claims, 7 Drawing Figures

Fig. 4
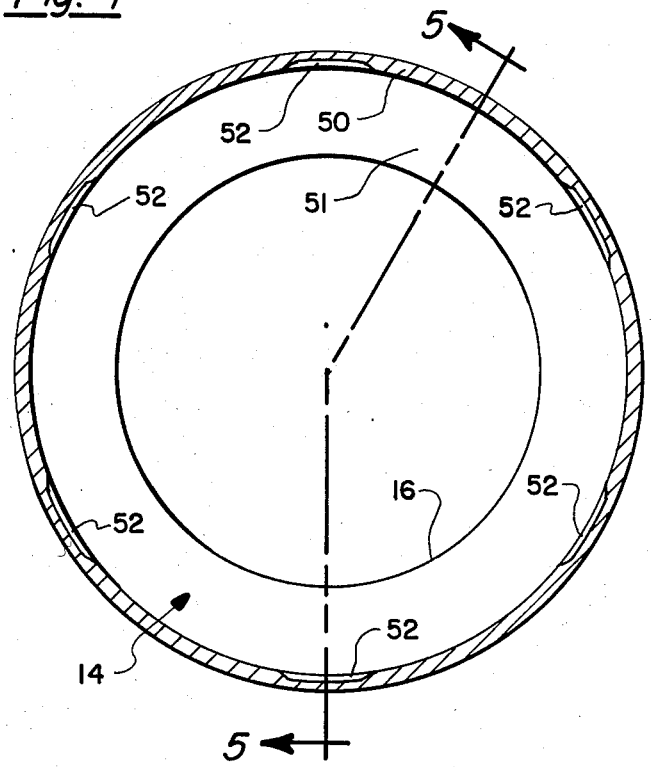
Fig. 5
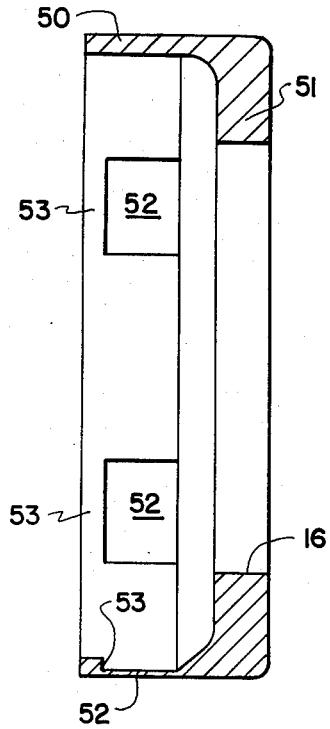
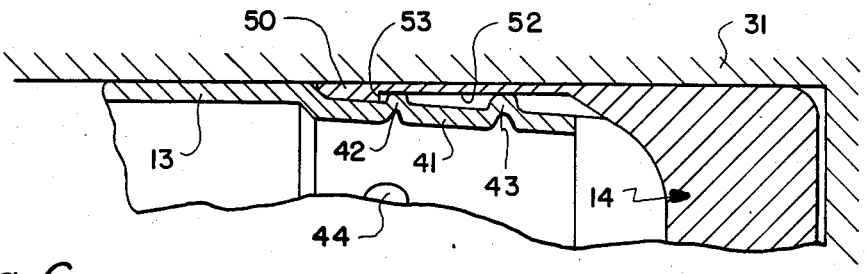
Fig. 6
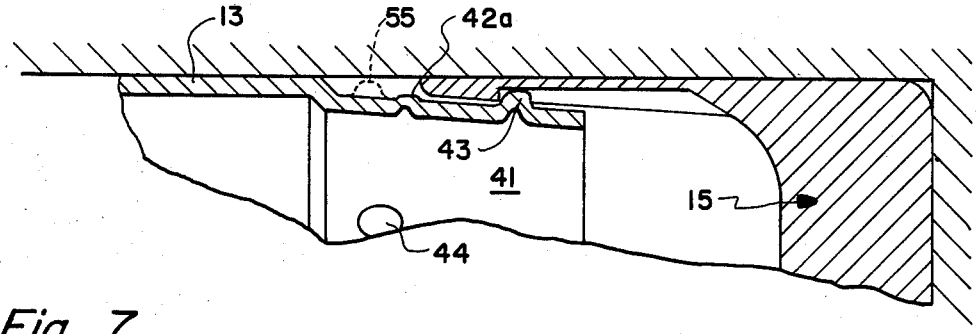
Fig. 7

CASED TELESCOPED AMMUNITION

FIELD OF THE INVENTION

The invention relates to the field of munitions, and particularly to improvements in the construction of cased telescoped ammunition.

Ammunition of this type is used in automatic weapons, which feed the live cartridges to the chamber of a firing piece, and clear the spent cartridge cases from the chamber. As is well known, the cartridge case for such a device comprise a body and a pair of end caps, one cap having a central aperture to enable discharge of the projectile from the case.

BACKGROUND OF THE INVENTION

It is known to secure the caps to the casing body of such a device by adhesive means, but the possibility exists for the adhesive bonds to be ruptured by the force of the firing explosion, which can have two undesirable effects. First, it could cause the overall axial length of the case and caps to increase to the point of binding in the firing chamber, making weapon clearing difficult. Second, the caps could entirely separate from the body during clearing, and as loose members fall into the automatic feeding and clearing mechanism, thus disabling the piece.

The present invention comprises an arrangement for securing an end cap to a telescoped cartridge case in such a way as to enable and yet limit enforced axial movement therebetween.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals identify corresponding parts throughout the several views.

FIG. 4 is an end view of a cap used in the invention, partly in section as viewed along section line 4—4 of FIG. 5;

FIG. 5 is a sectional view looking along the line 5—5 of the cap of FIG. 4;

FIG. 6 is an enlarged fragmentary sectional view of the connection between the body of FIG. 2 and the cap of FIG. 4 in normal state; and FIG. 7 shows the elements of FIG. 6 after discharge of the ammunition.

DESCRIPTION OF THE PREFERRED EMBODIMENT

Figure 1:
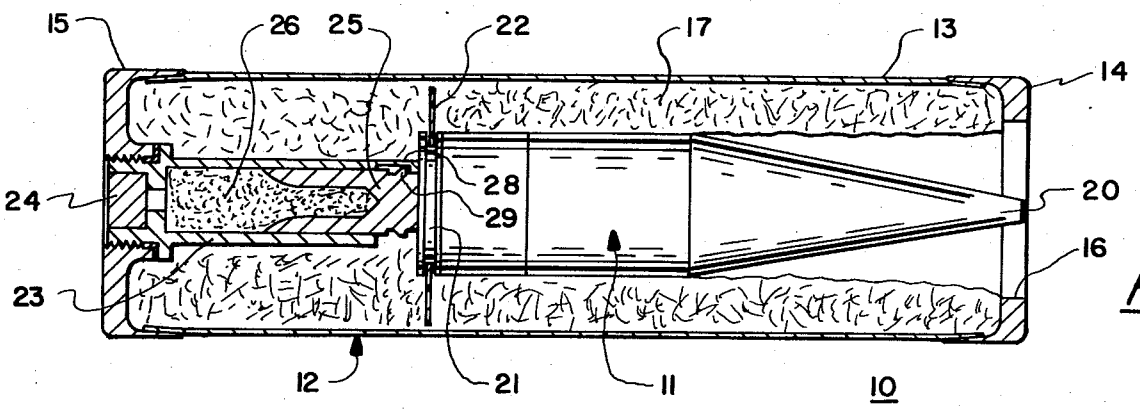
FIG. 1 is a view in longitudinal section of a cartridge embodying the invention.

Referring first to FIG. 1, a munition 10 of the type in question is shown to comprise a projectile 11 telescoped within a casing 12 comprising a body 13 of somewhat resilient metal and a pair of end caps 14 and 15. Cap 14 has a central aperture 16 to enable the projectile to leave the casing. The projectile is embedded in a consolidated propellant 17, and has a forward aerodynamic point 20. The rear portion of the projectile has a groove 21 to receive a shear washer 22 embedded in propellant 17. Cap 15 contains a central control tube 23 extending axially into the case and closed outwardly by a primer 24. A piston 25 extends rearwardly of the projectile into the control tube, and the tube and piston contain black powder 26 to be ignited by the primer.

A plurality of resilient fingers, one of which is shown at 28, extend beyond the end of tube 23 and are recessed to engage a shearable ridge 29 extending from piston 25, to further secure the projectile in the cartridge case.

When the black powder is fired by the primer, it initiates movement of the projectile through the propellant, shearing washer 22, and piston 25 travels with the projectile, thus shearing ridges 29 and clearing a gap through which propellant 17 may be ignited by the black powder. The rate of burn of the propellant 17 is no greater than the rate of movement of projectile 11, so propulsion continues as the projectile is discharged out of the casing through end cap 14.

During this procedure, the cartridge is contained within the chamber of a firing piece which closely surrounds casing 13 laterally but is spaced slightly from the cartridge at its ends to facilitate loading and clearing.

Structure thus far described is well known to those skilled in the art: attention is now directed to FIGS. 2–6, which give details of the inventive connection between the cartridge case body and the end caps, which comprises the subject matter of this application.

Figure 3:
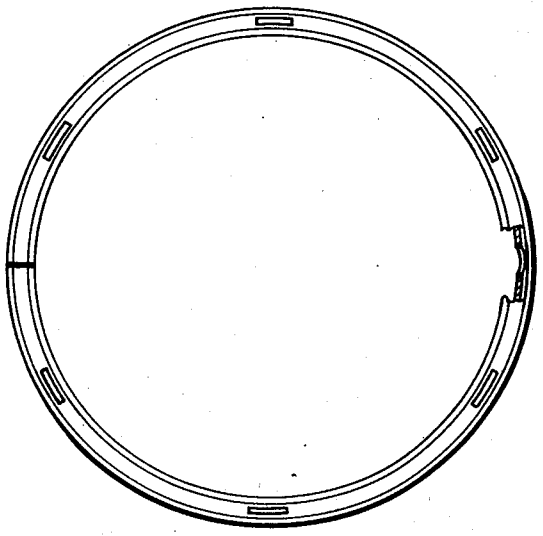
FIG. 3 is an end view of FIG. 2.
Figure 2:
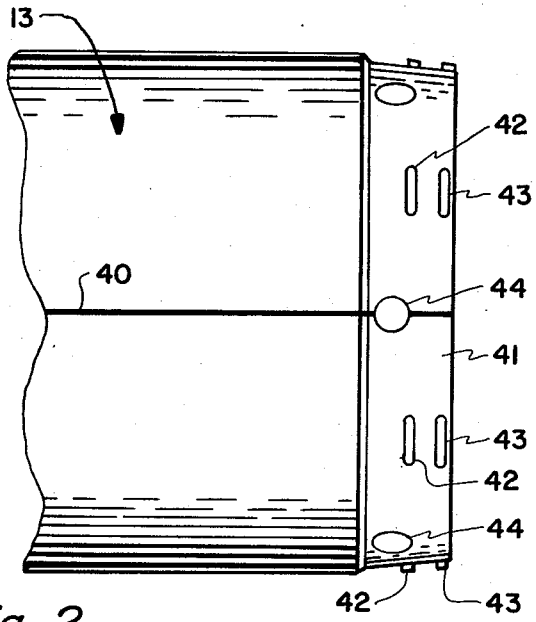
FIG. 2 is a fragmentary side view of a cartridge case body according to the invention, to a larger scale.

As shown in FIGS. 2 and 3, the body 13 is formed as a cylinder having a longitudinal butt joint 40. A lip 41 of slightly smaller diameter with a slight inward taper is formed at the end of body 13. Lip 41 and attendant features are repeated at the other end of the body. At six locations, spaced around lip 41, pairs of nipples 42,43 are formed outwardly of the lip: they are generally rectangular in outline, and are axially spaced, nipples 43 being nearer the edge of the lip than nipples 42.

Also spaced around each lip 41 are six pressure relief apertures 44 located between the sets of nipples, and centered further from the edges of the lips than the nipples.

End cap 14 is shown to a larger scale in FIGS. 4 and 5: it comprises a rim 50 rising from an end plate 51 in which aperture 16 is formed. At locations around the rim corresponding to the locations of nipple pairs 42,43 in lip 41 there are formed outward notches 52 having square walls 53 and of depth to receive nipples 42,43. The inner face of rim 50 tapers to agree with the taper of body lip 41, but notches 52 are not tapered.

FIG. 6 shows that each notch 52 is dimensioned to receive a pair of nipples 42 and 43, and that nipple 42 is lower than nipple 43 since the former is further up on the tapered surface of cap 41. When the cap is assembled to the body the two tapered surfaces engage smoothly to form a seal, and are held together by nipples 42 engaging walls 53. Similar structure is provided in end cap 15.

The axial location of pressure relief apertures 44 relative to nipples 42 and 43 is also shown in FIG. 6.

OPERATION

When the cartridge is fired, a high pressure builds up within casing 12, and acts in all outward directions. End caps 14 and 15 are forced outward against the ends of the chamber, which expands momentarily in all directions to act as a very stiff spring. Since body 12 is somewhat resilient, it opens slightly under pressure along joint 40, rather than yielding permanently to result in a tight fit when the chamber contracts upon pressure relief, to prevent binding in the chamber.

Longitudinal expansion in response to internal pressure is permitted by movement of one or both of the end caps axially away from the normal position shown in FIG. 6, so that they engage the ends of the firing chamber and cause it to expand axially. During this process it usually occurs that wall 53 of notch 52 shears off the crest of nipple 42 leaving only a stub 42*a* as shown in FIG. 7. The linear expansion possible in the chamber is not sufficient, however, to enable wall 53 to shear off nipple 43, so that the cap remains secured to the lip of body 13.

After the projectile leaves the chamber the pressure drops, and the chamber can contract, causing cap 15 to return to its initial position undeterred by stub 42*a*. The cartridge case is thus not bound in chamber 31 either laterally or axially, and automatic clearing of the spent casing can proceed without difficulty, the end caps 14 and 15 remaining with body 13.

Practical use of the cartridge described above made it evident that sometimes the high pressure deforms lip 41 outwardly to restore nipple 42 or create a new nipple suggested at 55 in FIG. 7. The provision of apertures 44 is to relieve the pressure within lip 41 to a value which does not result in the formation of adventitous lips such as lip 55. Like the slight opening of butt joint 40, these apertures do not materially affect the discharge of projectile 11.

From the above it will be evident that I have invented a cartridge case construction which allows essential expansion of the case during firing, but prevents permanent deformation of the case to an extent which would interfere with automatic clearing, while insuring that the end caps remain with the body during clearing.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

The embodiments of the invention in which an exclusive property or right is claimed are defined as follows:

1. A cased telescoped ammunition for use with a gun having a barrel and chamber, said ammunition comprising:

a cylindrically shaped hollow body of resilient relatively thin material, said body having two axial ends and a butt joint extending longitudinally between said axial ends;

lip means integral with said body at each of said axial ends, each said lip means:

extending axially away from said body with an inward taper to an outboard edge surface having a diameter less than the diameter of said body, and having a plurality of pairs outwardly extending nipples circumferentially disposed around the outer surface of each said lip means, each of said pairs of nipples comprising an inboard nipple and an outboard nipple; and a pair of end caps respectively connected to said lip means of said axial ends of said hollow body, each of said end caps comprising:

a radially extending end portion, a continuous rim portion integral with said end portion and extending axially to an inner edge surface, axially extending notch means on the inner surface of said axially extending rim portion, said notch means being positioned beginning at a preselected point axially spaced from said inner edge surface and extending axially outboard a preselected distance equal to at least the axial extent of each of said pairs of nipples;

said end caps being connected to said body, as aforesaid, by said rim portion inner edge surface being positioned axially inboard from said inboard nipples and with all of said nipples being disposed in said axially extending notch means, and said inboard nipples being characterized by being shearable by said rim portions of said end caps upon relative outboard axial movement of said end caps with respect to said body, and said end caps being thereafter retained in assembled relationship with said body by said outboard nipples.

2. Apparatus of claim 1 further characterized by said notch means comprising a plurality of individual recesses on the inner surface of the axially extending rim portions of said end caps, said recesses being circumferentially in register with said plurality of pairs of nipples.

3. Apparatus of claim 1 characterized by said lip means having at least one pressure relief aperture means therein.

4. Apparatus of claim 2 characterized by said lip means having at least one pressure relief aperture means therein.

* * * * *